United States Patent [19]

Greiner et al.

[11] 4,182,298

[45] Jan. 8, 1980

[54] WARM-UP CONTROL APPARATUS FOR A FUEL SUPPLY SYSTEM

[75] Inventors: Max Greiner, Gerlingen; Hermann Nusser, Asperg, both of Fed. Rep. of Germany

[73] Assignee: Robert Bosch GmbH, Stuttgart, Fed. Rep. of Germany

[21] Appl. No.: 973,662

[22] Filed: Dec. 27, 1978

Related U.S. Application Data

[63] Continuation of Ser. No. 801,871, May 31, 1977.

[30] Foreign Application Priority Data

Jun. 25, 1976 [DE] Fed. Rep. of Germany ..... 2628666

[51] Int. Cl.[2] ..... F02B 3/00; F02M 1/02

[52] U.S. Cl. ..... 123/139 AW; 123/139 BG; 123/179 L; 261/50 A; 261/39 C; 261/39 E

[58] Field of Search ..... 123/139 AW, 139 BG, 123/179 L, 33 A; 261/50 A, 39 B, 39 C, 39 E

[56] References Cited

U.S. PATENT DOCUMENTS

| | | | |
|---|---|---|---|
| 2,309,170 | 1/1943 | Beaumont | 261/39 E |
| 3,739,758 | 6/1973 | Knapp et al. | 123/139 AW |
| 4,108,117 | 8/1978 | Stumpp et al. | 123/139 AW |

FOREIGN PATENT DOCUMENTS

| | | | |
|---|---|---|---|
| 2403276 | 7/1975 | Fed. Rep. of Germany | 123/139 AW |
| 2529701 | 1/1977 | Fed. Rep. of Germany | 123/139 AW |
| 2547645 | 5/1977 | Fed. Rep. of Germany | 123/139 AW |
| 2307136 | 5/1976 | France | 123/139 AW |
| 1406305 | 9/1975 | United Kingdom | 123/139 AW |

*Primary Examiner*—Charles J. Myhre
*Assistant Examiner*—P. S. Lall
*Attorney, Agent, or Firm*—Edwin E. Greigg

[57] ABSTRACT

A warm-up fuel control apparatus for an internal combustion engine including a pressure control valve for maintaining a pressure differential at a fuel proportioning valve, the pressure control valve having a moveable valve component subjected to fuel pressure on one side and urged into a valve closing position by both a pressure spring and a leaf spring on the other side together with a heat expandable element engageable with the leaf spring for removing the urging force of the leaf spring for removing the urging force of the leaf spring on the movable valve component after the warm-up phase of the engine.

9 Claims, 4 Drawing Figures

WARM-UP CONTROL APPARATUS FOR A FUEL SUPPLY SYSTEM

This is a continuation, of application Ser. No. 801,871, filed May 31, 1977.

BACKGROUND OF THE INVENTION

The invention relates to improvements in a warm-up control apparatus for a fuel supply system of a mixture compressing, externally ignited internal combustion engine having a pressure control valve which determines the pressure drop at a fuel proportioning valve, particularly a structure in which the pressure control valve includes a movable valve component that is biased on one side by the fuel pressure and biased on the other side by a pressure spring.

OBJECT AND SUMMARY OF THE INVENTION

Accordingly, it is a primary object of this invention to provide a fuel injection system of the aforementioned type which functions in a simplified manner and requires only a single pressure control valve to regulate the pressure drop at the fuel proportioning valve.

Another object of this invention is to utilize a leaf spring as the closing force for the movable valve component.

Still another object and advantage of this invention is to use an expansion material member as the temperature dependent element, since an exact accommodation of the fuelair mixture to the given requirements of the combustion engine during the warm-up phase is made possible by choosing an expansion material member of an appropriate characteristic temperature excursion curve.

The invention will be better understood as well as further objects and advantages and embodiments thereof become more apparent from the ensuing detailed description of exemplary preferred embodiments taken in conjunction with the drawings.

DESCRIPTION OF THE PREFERRED EMBODIMENTS

Figure 1:
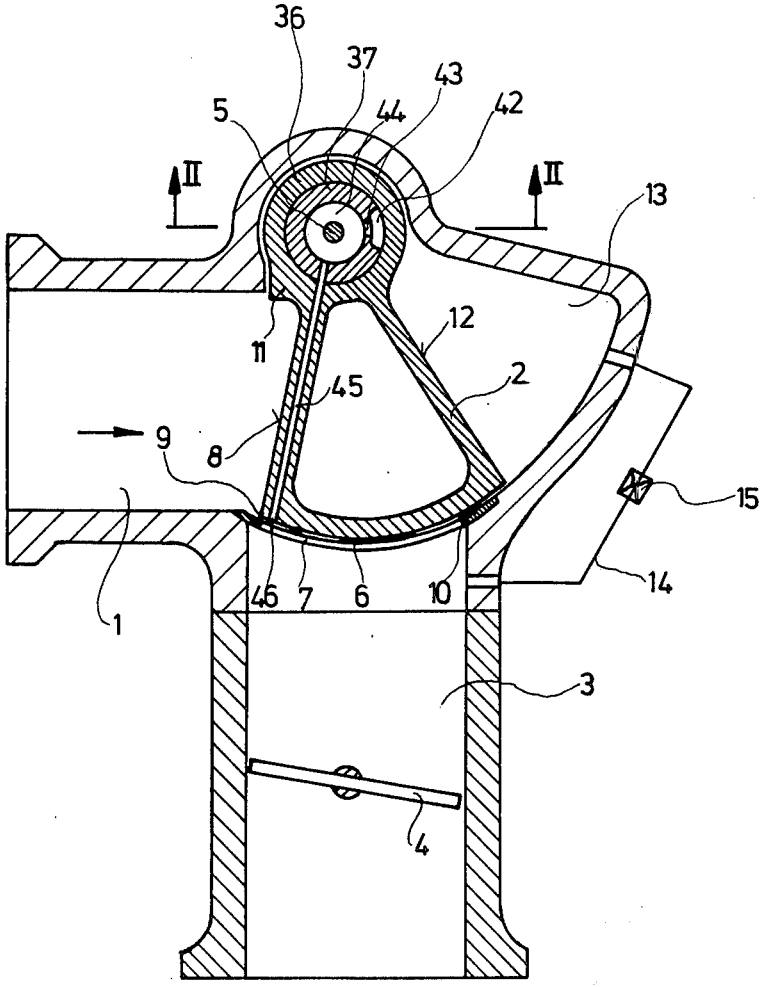
FIG. 1 is a cross section through a first exemplary embodiment of a fuel injection system according to the line I—I of FIG. 2.

Turning now to FIG. 1, there is shown a fuel injection system with parts of an engine in which the air necessary for combustion flows in the direction of the arrow into a region 1 of the induction tube which encloses an air flow rate responsive element 2. The air then traverses a region 3 of the induction tube which encloses an arbitrarily settable throttle valve 4 and finally continues to one or several cylinders, not shown, of an internal combustion engine. The air flow element 2 is pivoted at one side about a transverse fixed shaft 5 and is embodied as a valve element which has the radial cross section of a circular sector and which completely traverses the inside diameter of the induction tube. The face 6 of the valve element 2 cooperates with and passes an aperture 7. It is advantageous for reasons of weight and cost savings if the valve element 2 is hollow.

The surface 8 of the valve element 2 facing the air stream has an edge 9 which controls the degree of opening in the aperture 7 in dependence on the aspirated air quantity. The aperture 7 is preferably disposed within a foil 10. The region 1 of the induction tube is entirely traversed with tight radial clearance by the valve element 2. A stop 11 limits the clockwise rotation of the valve element 2. The surface 12 of the valve element 2 remote from the air stream enters a damping chamber 13 which is coupled via a line 14 containing a throttle 15 with the induction tube region 3 downstream of the aperture 7. As a result, any pressure oscillations which are due to the suction strokes of the engine do not have any influence on the angular position of the valve element 2. The motion of the valve element 2 within the appropriately shaped air induction tube region 1 takes place in approximation to a linear function of the air flow rate in the induction tube. If the pressure ahead of the valve element 2 is constant, then the pressure between the valve element 2 and the throttle valve 4 is also constant.

Figure 2:
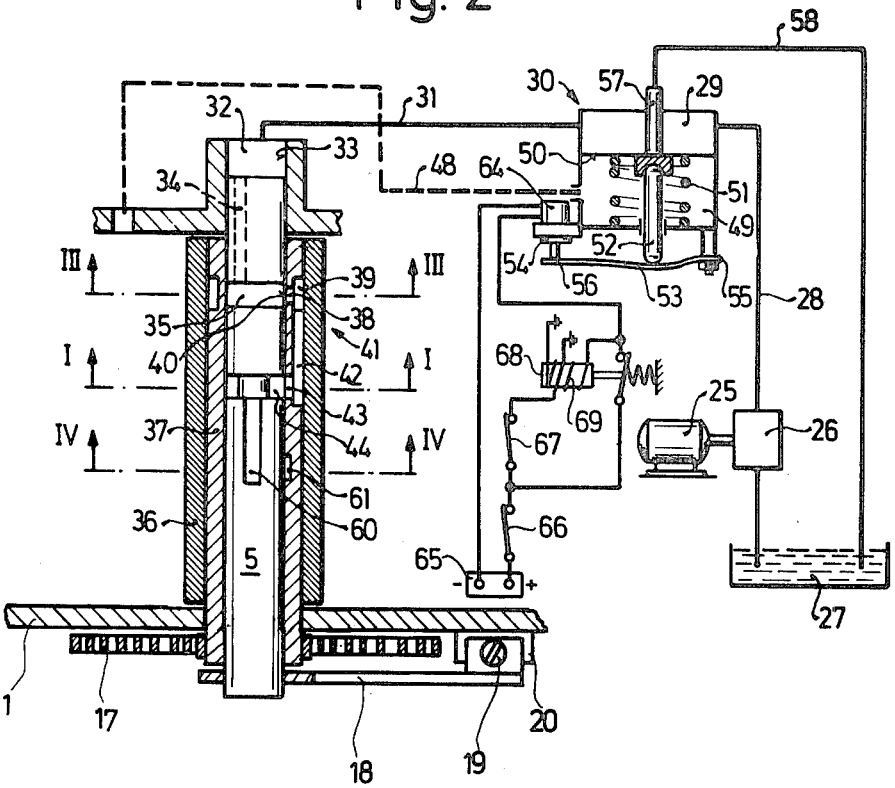
FIG. 2 is a section along the line II—II in FIG. 1.
Figure 3:
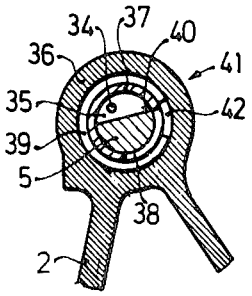
FIG. 3 is a section of the fuel injection system along the line III—III in FIG. 2.

Turning now to FIG. 2, it will be seen that fuel is supplied to the system by an electric motor 25 which drives a fuel pump 26 that aspirates fuel from a fuel container 27 and delivers it via a line 28 to a chamber 29 within a differential pressure valve 30. From the chamber 29, fuel flows through a line 31 into a chamber 32 which is defined by the end face of the bearing shaft 5 and its guide bore 33 in an extension of the induction tube wall. A bore 34, shown in broken lines in FIG. 2, establishes communication of the chamber 32 with a groove 35 worked into the bearing shaft 5. The valve element 2 is affixed on a sleeve 36 which is fixedly attached to a bushing 37 rotating on the bearing shaft 5. The bushing 37 has a control slot 38 terminating in an annular groove 39. The control slot 38 cooperates with a control edge 40 (see FIG. 3) which is formed by the end surface of the groove 35 in the bearing shaft. Depending on the position of the valve element 2, the control edge 40 opens the control slot 38 to varying degrees for metering out a fuel quantity proportional to the aspirated air flow rate. Thus, the control edge 40 and the control slot 38 together form a fuel metering valve 41 within the bearing shaft 5 of the valve element 2. The metered fuel flows from the annular groove 39 through a groove 44 in the bearing shaft 5. The annular groove 44 communicates with a line 45 disposed within the face portion of the valve element 2 and the line 45 opens in the vicinity of the aperture-controlling edge 9, e.g., at the end-face of the valve element 2, through an injection nozzle 46, into the portion of the passage 7 opened by the edge 9, as best seen in FIG. 1. In a variant embodiment, which is not illustrated, the line 45 might terminate in several nozzles 46 located in the end surface of the valve element 2. As another variant, the injection nozzle 46 might be a slit extending nearly over the entire width of the end surface of the valve element 2. In yet another embodiment, not illustrated, the injection nozzle 46 might be a fuel injection valve.

The apportionment of the fuel by the metering valve 41 takes place at a constant pressure differential. To accomplish this (see FIG. 2) the differential pressure valve 30 includes a diaphragm 50 which separates it into two chambers 29 and 49 respectively, chamber 49 being connected by dot-dashed line 48 with region 1 of the suction tube upstream of the valve element 2, so that the same pressure prevails in the chamber 49 as prevails downstream of the control slit 38.

The pressure control valve 30 is biased in a closed direction by means of a pressure spring 51 located in the chamber 49. The force upon the diaphragm 50 which acts in the direction of closure of the pressure control valve 30 is variable via an actuating pin 52 that cooperates with a leaf spring 53 that is influenced by a temperature dependent element 54. The actuating pin 52 rests on the leaf spring 53 approximately medially of its longitudinal center. The leaf spring 53 is captively secured at the end 55 to the differential pressure valve 30, and its free end 56 is arranged to cooperate with the temperature dependent element 54 that preferably comprises an expansion material element 54.

The differential pressure valve 30 is embodied as a flat-seated valve whose diaphragm 50 is its movable valve component which cooperates with a fixed valve seat 57 over which fuel may flow into a return line 58 which terminates in the fuel container 27. The differential pressure valve 30 serves at the same time as a system pressure valve.

The excursion of the valve element 2 takes place in opposition to the force of a spiral spring 17, one end of which is connected to the bushing 37 while the other end is attached to a stop member on the air induction tube.

The basic setting of the fuel metering valve 41 may be adjusted by rotating the bearing shaft 5 with respect to the valve element 2 by means of a lever 18 and a screw 19 abutting a stop 20.

Figure 4:
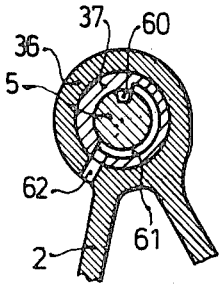
FIG. 4 is a section along the line IV—IV in FIG. 2.

A favorable feature of the invention is that the metered-out fuel is mixed with air prior to injection in the air induction tube. For this purpose, as shown more clearly in FIG. 4, the annular groove 44 communicates with an air hole 62 in the face 8 via a groove 60 and an annular groove 61. The air hole 62 leads to the interior of the air induction tube 1 upstream of the valve element 2. The annular groove 61 is preferably so embodied that it covers the groove 60 only when the engine runs at least at minimum idling rpm. This feature prevents the admission of an incombustible fuel-air mixture during engine start up. The same purpose could be achieved by placing the terminus of the injection nozzle 46 a small distance upstream of the edge 9 or by placing it so as to be very close to the induction tube wall. The admixture of air to the metered fuel prior to injection in the induction tube results in an improved mixture preparation.

The mixing of the apportioned fuel quantity with air prior to its injection into the air intake pipe yields the advantage of a better mixture preparation.

The temperature dependent element 54 incorporates an electrical heater winding 64 powered by the vehicle battery with the current circuit being closed by means of the ignition switch 66 and the starter switch 67 via a relay 68 which includes an actuating coil 69.

The operation of the fuel supply system of this embodiment of warm-up control apparatus is as follows:

Depending on the displacement of the valve element 2, the control edge 9 more or less opens the aperture 7. The direct control of the fuel apportioning valve 41 by the valve element 2 yields an essentially constant relation between the aspirated air quantity and the apportioned fuel quantity. The apportionment takes place at a given pressure differential maintained by means of the pressure control valve 30 in which the closure force which acts on the diaphragm 50 during the warm-up phase of the internal combustion engine is variable in particular via the spring force of the spring 53, thus varying the pressure differential for the desired enrichment of the fuel-air mixture. The injection of the apportioned fuel takes place via the injection jet 46 which is located for example, at the end face of the valve element 2 near the control edge 9 and is directed into the aperture 7, near the point of greatest flow velocity, in order to obtain the most homogeneous fluid-air mixture possible.

The fuel injection system according to the present invention provides the advantage that the location of the fuel metering assembly 41 in the bearing shaft 5 makes possible a very compact construction and, furthermore, since the fuel injection occurs through the end face of the valve element 2 near the control edge 9, all fuel lines may be made very short and a very good mixture integration is obtained. Yet another improvement of the fuel mixture preparation results from admixing air with the metered-out fuel prior to injection in the induction tube.

The air flow meter embodied as a rotating valve element offers the advantage of being very stable mechanically and relatively immune against high pressure surges, for example back-fires. Furthermore, the wettable surface area when closed is less than in a comparable air metering flap with a damper baffle. Another particular advantage is that the rotary valve element cooperates with an aperture in a foil that is easily exchanged so as to be adaptable to any particular type of engine.

When the internal combustion engine is cold a relatively richer fuel-air mixture must be supplied to facilitate starting of the engine, and the continued running for a time thereafter, of the internal combustion engine. This fuel enrichment during the warm-up phase takes place, according to the invention, through the controlled increase of the pressure drop at the fuel apportioning valve 41 by means of the pressure control valve 30. To this end, the leaf spring 53 can bias the diaphragm 50 via the actuating pin 52 in the direction of closure of the pressure control valve 30 in conjunction with the force of the pressure spring 51. The force of the leaf spring 53 which acts on the diaphragm 50 is determined by the temperature dependent element 54 which acts against the free end 56 of the leaf spring 53. The temperature dependent element 54 is preferably designed such as to provide a regressive characteristic temperature excursion curve, so that the deflection of the leaf spring 53 by means of the temperature dependent element 54 decreases with a rise in temperature. As a consequence a particularly good mating is obtained of the fuel enrichment relative to the required non-linear enrichment curve during the warm-up phase. The leaf spring 53 is biased in such a way by the temperature dependent element 54 that it no longer exerts any force on the diaphragm 50 after the completion of the warm-up phase at a temperature above approximately +70 degrees centigrade, that is the leaf spring 53 then no longer interacts with the diaphragm 50. When starting the internal combustion engine above a temperature of approximately +70 degrees centigrade, no fuel enrichment then takes place via the warm-up control apparatus disclosed in this embodiment of the invention. In order to obtain a fast diminution of the fuel enrichment subsequent to the starting of the engine, the temperature dependent element 54 is provided with an electrical heater winding 64. When, during the starting of the internal combustion engine, the ignition switch 66 and subsequently the starter switch 67 are actuated, then the relay 68 responds and closes the current circuit from the electrical heater winding 64 to the vehicle battery 65. The relay 68 includes an actuating coil 69, so that even after the opening of the starter switch 67, that is after the completion of the starting process, the relay 68 remains actuated and the electrical heater winding 64 continues to receive a heating current. Any other suitable temperature dependent element can also be used in lieu of the element 54 discussed herein.

What is claimed is:

1. Warm-up control apparatus for a fuel supply system of an externally ignited internal combustion engine including a fuel apportioning valve, a pressure control valve for maintaining the pressure differential at said fuel apportioning valve, said pressure control valve having a movable valve component biased on one side by means of a fuel pressure, a first spring for biasing said movable valve component on the other side, a second spring for yieldingly urging said movable valve component into a valve closing position during the warm-up phase of the internal combustion engine and a temperature dependent element movable between an operative position in engagement with said second spring for removing the urging force of said second spring on said movable valve component after completion of the warm-up phase of said engine and an inoperative position out of said engagement with said second spring during said warm-up phase.

2. Warm-up control apparatus according to claim 1, further characterized in that a leaf spring serves as the second spring.

3. Warm-up control apparatus according to claim 1, including an actuating pin means on said movable valve component of said pressure control valve, said leaf spring being arranged to engage said actuating pin for yieldingly urging said movable valve component into said valve closing position.

4. Warm-up control apparatus according to claim 3, further characterized in that said actuating pin engages said leaf spring approximately at the longitudinal center thereof.

5. Warm-up control apparatus according to claim 3, further characterized in that said leaf spring is affixed at one end to a housing and includes a free end which contacts the temperature dependent element.

6. Warm-up control apparatus according to claim 1, further characterized in that said temperature dependent element includes an expansion material member.

7. Warm-up control apparatus according to claim 6, further characterized in that said expansion material member comprises a regressive characteristic temperature excursion curve.

8. Warm-up control apparatus according to claim 1, including an electrical heater winding whose current circuit is closed by means of the ignition switch and the starter switch for actuating said expansion material member.

9. Warm-up control apparatus according to claim 8, further characterized in that said current circuit of the electrical heater winding remains closed subsequent to opening of the starter switch.

* * * * *